United States Patent [19]

Ferraro

[11] Patent Number: 5,016,381

[45] Date of Patent: May 21, 1991

[54] REMOVABLE FRONT SIGHT FOR HANDGUNS

[75] Inventor: Robert J. Ferraro, Ludlow, Mass.

[73] Assignee: Smith & Wesson Corp., Springfield, Mass.

[21] Appl. No.: 581,594

[22] Filed: Sep. 12, 1990

[51] Int. Cl.[5] ..... F41G 1/02

[52] U.S. Cl. ..... 42/100; 33/233

[58] Field of Search ..... 33/233; 42/100

[56] References Cited

U.S. PATENT DOCUMENTS 2,788,600 4/1957 Pokorny ..... 42/100

4,015,354 4/1977 Brouthers ..... 42/100

*Primary Examiner*—Deborah L. Kyle

*Assistant Examiner*—Richard W. Wendtland

*Attorney, Agent, or Firm*—Chapin, Neal & Dempsey

[57] ABSTRACT

Removable front sight for the barrel of a firearm has an upper blade portion, a generally rectangular base portion and a lower shank portion. The base portion is adapted to fit into a correspondingly shaped recess and the shank portion is generally cylindrical in shape to fit into an upwardly opening bore formed in the upper surface of the gun barrel and adjacent the muzzle end thereof. A longitudinal hole extends from the muzzle end of the barrel, communicates with the bore, and terminates rearwardly thereof to provide a housing for a combination spring and detent disposed therein. The detent is urged forwardly by the spring to engage, releasably, a groove in the shank having an axially opening entry portion and a detent receiving cavity angularly offset from the groove. A pin extends across the longitudinal hole and fits into a trough formed in the upper edge portion of the detent to limit the stroke of the detent. The spring is compressible sufficiently to enable the shank to be removably fitted into the bore by a combination of angular rotation and axial movement of the shank relative to the bore.

6 Claims, 2 Drawing Sheets

FIG. 1
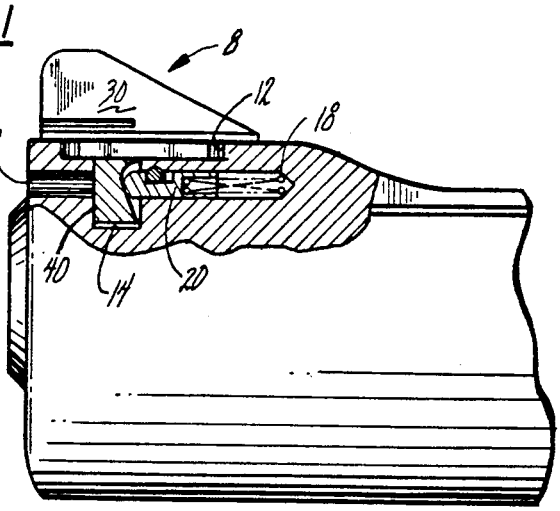
FIG. 2
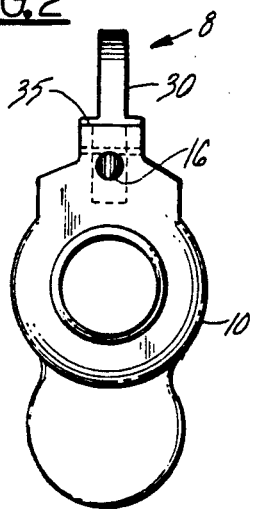
FIG. 3
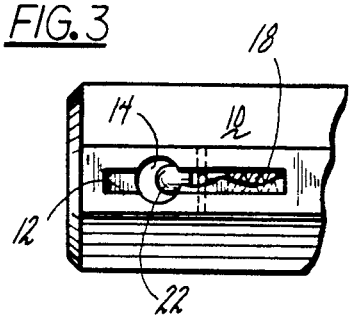
FIG. 4
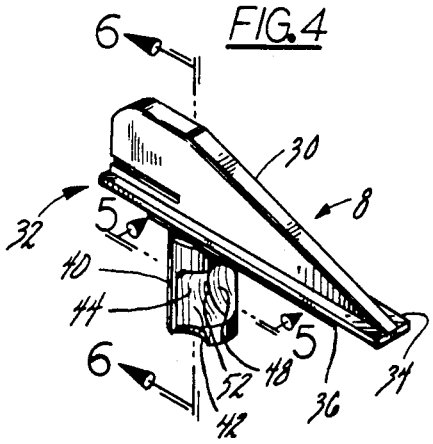
FIG. 6
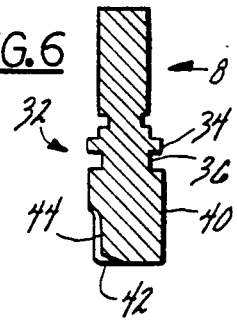
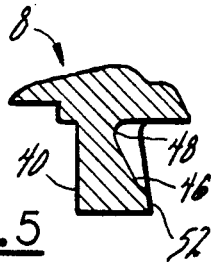
FIG. 5
FIG. 7
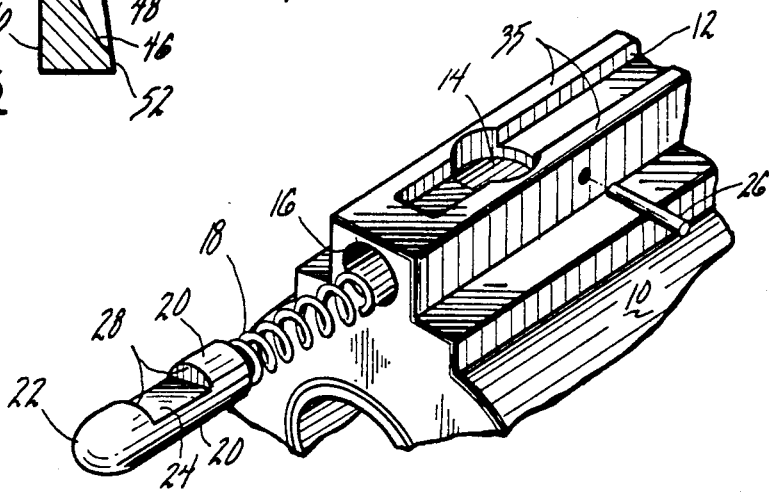

REMOVABLE FRONT SIGHT FOR HANDGUNS

BACKGROUND OF THE INVENTION

This invention relates to removable gunsights, such as used on handguns and, in particular, to such gunsights as may be removed from and remounted securely on the barrel of the gun without the use of tools and fasteners and which are not affected by recoil forces.

This invention also relates to removable front sights of a type generally similar to that disclosed in application Ser. No. 07/486,882, filed on Mar. 1, 1990, and which is assigned to the same assignee as is this application.

While U.S. Pat. No. 4,015,354 discloses a front gunsight which is removable from the barrel of a firearm, that sight requires the use of an Allen head type wrench to remove and replace the setscrew which fastens the sight in place on the barrel.

It is the principal object of the present invention to provide a gunsight removably fitted onto the muzzle end of the barrel of a gun which, although securely fastened in place on the gun barrel so that it will not be affected by recoil forces, is nonetheless readily removable and replaceable without the use of tools and requires no separable fasteners.

The above and other objects and advantages of this invention will be more readily apparent from the following description read in conjunction with the accompanying drawings in which:

FIG. 1 is a side elevational view, partly in section, of a removable front gunsight of the type embodying this invention as fitted onto the barrel of a handgun;

FIG. 2 is a front end view of the sight shown in FIG. 1;

FIG. 3 is a top plan view of the barrel of the gun shown in FIG. 1 with the sight removed;

FIG. 4 is a perspective view of the gunsight of FIG. 1 removed from the gun barrel;

Figure 8:
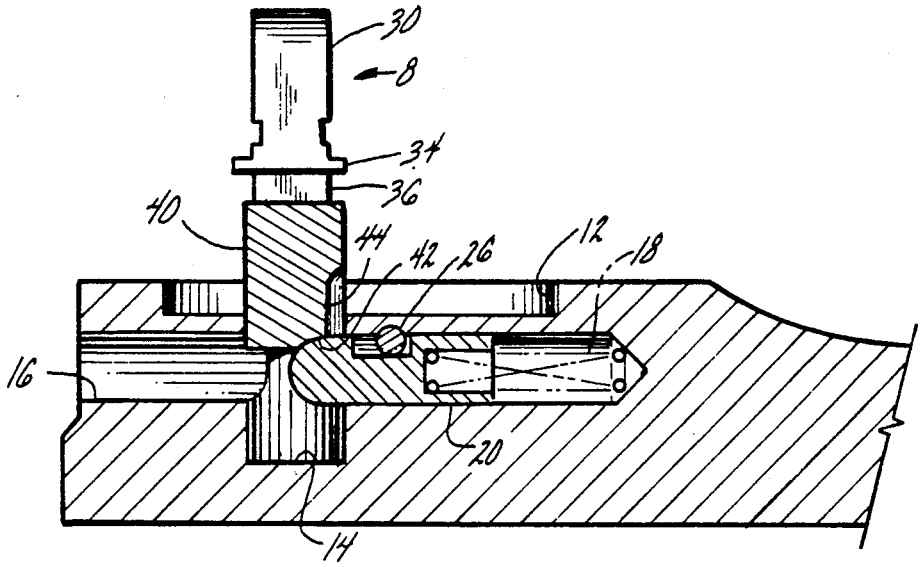

FIGS. 5 and 6 are sectional views respectively taken along lines 5—5 and lines 6—6 of FIG. 4.

FIG. 7 is an exploded, perspective view, on an enlarged scale, showing the muzzle end of the gun barrel of FIG. 1, and FIGS. 8–10 are side elevational veiws, partly in section, which illustrate the sequence of steps for mounting the sight on the gun barrel.

Referring in detail to the drawing, in FIG. 1 is shown a removable gunsight 8 of the type embodying this invention disposed on a gun barrel 10. The sight, shown generally at 8, disposed adjacent the muzzle end of the barrel, is fitted into a substantially rectangular recess 12 (FIG. 7) machined into the upper surface of the barrel at the conventional location of the front sight. A cylindrical bore 14 extends vertically from the bottom surface of recess 12 through a longitudinal hole 16 that extends rearwardly from the muzzle end of the barrel. The hole 16 extends a sufficient distance beyond bore 14 to accommodate therein a combination of a coil spring 18 and detent pin, or plunger 20. The spherical tip 22 of detent 20 is urged by spring 18 into bore 14 to serve as means for releasably retaining the sight 8 in assembled relation on the barrel 10. The inner end of the detent is hollow, or tubular to provide a seat for spring 18. The upper surface of the detent is provided with an elongated cutout or recess 24 adapted to receive the medial portion of cross-pin 26. The cross-pin serves to retain the detent and spring assembly in place within hole 16 while the opposed vertical edges 28 of the cutout 24 define the length of the longitudinal stroke of the detent 20.

The sight 8, per se, is of integral construction and includes an upper blade portion 30 of any desirable configuration, an intermediate base portion 32 and a lower shank piece, or portion 40, adapted to fit into bore 14. The blade 30 may be of any desired shape, size and color and it is within the purview of this invention to provide a plurality of interchangeable front sights of diverse type for various shooting or match conditions. The base 32 is of stepped construction and comprises a generally rectangular planar flange 34 adapted to be supported on the upper surface formed by the marginal edges 35 of the recess 12 and a narrower and shorter beam or keel 36 adapted to fit into recess 12. The lateral dimension of the keel is such that it will have a slip-fit clearance with the side edges of recess 12. The keel 36 has a depth, below flange 34, slightly less than the depth of recess 12 so that when the keel 36 is disposed in recess 12, the underside of flange 34 will be fully supported and oriented by surface 35. The keel 36 also has a planar lower surface adapted for easy rotation upon the edges 35 of the barrel disposed about the perimeter of recess 12.

Sight retaining means comprises the spring 18 and detent 20 which coact with the outer surface of the shank 40, sculptured for that function. When fitted into the inner end of longitudinal hole 16, the spring 18 will urge the detent 20 forwardly so that its conical tip extends a substantial distance into the bore 14 (FIG. 3) for engagement with the sculptured surface of the shank 40. The detent 20 and shank 40 cooperate to selectively lock and release the shank from the bore 14 in response to the horizontal angular orientation and axial movement of the shank.

Figure 9:
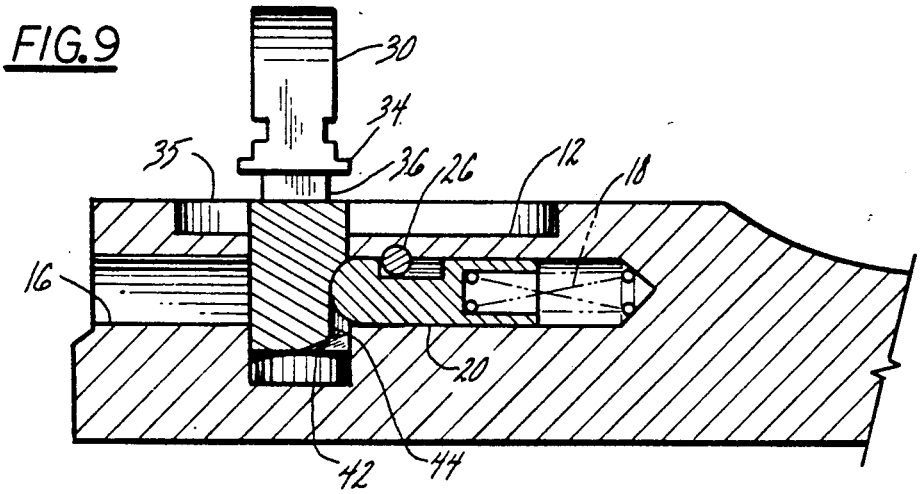
Figure 10:
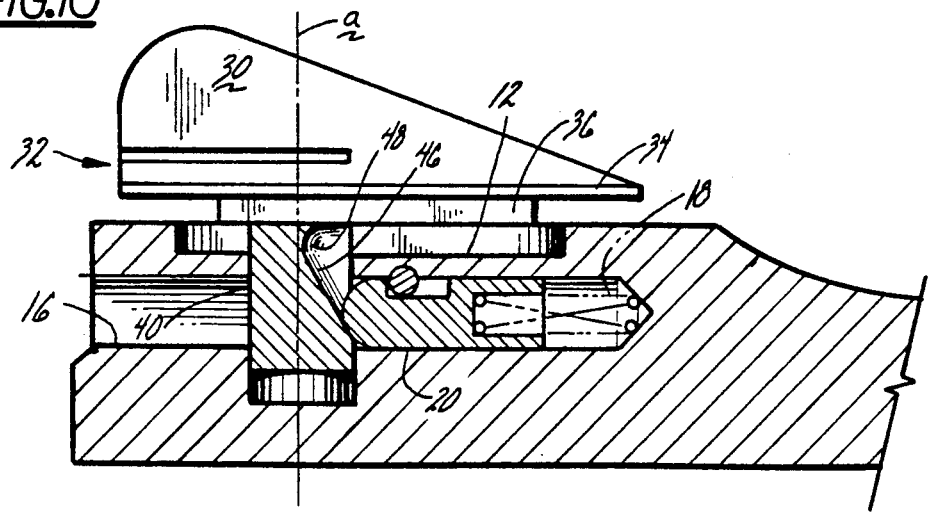

As best illustrated in FIGS. 4–6, the shank 40 is a solid cylindrical member which extends approximately 0.25 inch from the undersurface of the keel 36 and has a slip-fit clearance within the upright bore 14 of the gun 10 for stability of the sight. The shank 40 is provided at its lower edges with a chamfer, or lead-in cam 42 which functions to cam the detent 20 rearwardly for insertion of the shank into the bore 14, as depicted in FIG. 8. A groove 44 for receiving the tip of detent 20 extends longitudinally from chamfer 42 and in the same radial direction to provide a guideway for the detent 20, whereby the shank 40 may be partially inserted into the bore 14, as depicted in FIG. 9. Disposed at an angle of approximately ninety degress (90°) from the longitudinal groove 44, is an upwardly and inwardly inclined cam surface 46 which terminates a spherical cavity, or socket 48 to receive the detent 20. The groove 44 and cavity, including the cam surface 46, are interconnected or communicate by means of a circumferentially oriented channel 50. The shank is sculptured so as to include a skirt 52 at its lower edge, below channel 50 and cam surface 46 to prevent axial removal of the shank from the bore 14, unless the groove 44 and detent 20 are in axial alignemnt. This channel arrangement provides for relative movement therein of the detent 20 to enable ninety degress (90 °) of horizontal rotation of the sight 8 and its shank about vertical axis a to the position depicted in FIG. 10. From that orientation, the sight will be cammed, or "snap-fitted" by action of spring biased detent 20 automatically to its fully seated and locked position on the gun barrel, as depicted in FIG. 1.

In operation, a sight 8, embodying this invention, is removed and installed in a manner somewhat similar to a key operated locking device, such as an automobile ignition key. To remove the sight 8 from its seated and locked position, one simply need clasp the sight blade 30 manually and pull directly upwardly. A moderate rectilnear force will cause cam surface 46 (FIG. 10) to move detent 20 rearwardly, compressing spring 18. At the lower end of the shank 40, skirt 52 (FIG. 5) will prevent further axial withdrawal of the shank 40 from bore 14. To further unlatch the shank from the detent 20, the sight must be horizontally rotated ninety degress (90°), about its vertical axis a, in a given direction, such as counterclockwise. During such rotation, the undersurface of keel 36 rotates upon the barrel edges or surface 35 (FIGS. 7 and 9). To complete removal of the sight 8 from its unlocked position, in FIG. 9, it is only required to pull the sight directly upward until the shank 40 clears detent 20. Having removed the sight, another sight having a blade of different size, shape and or color, may now be readily mounted on the gun barrel by a sequence of steps illustrated in FIGS. 8 through 10, essentially the reverse of what has already been described. In FIG. 8, the sight is positioned perpendicular to the barrel with chamfer 42 aligned to engage the tip of detent 20 and with straight downward pressure, the spring 18 will be compressed, allowing the shank 40 to be received within groove 44 and thus inserted into bore 14 to its FIG. 9 position. Clockwise rotation of ninety degrees (90°) with detent 20 following the channel 50 until the sight 8 is disposed to its FIG. 10 position from which the coaction of the spring acutated detent 20 and can surface 46 will cause the sight 8 to snap into place with keel 36 fitted into recess 12, as depicted in FIG. 1.

The dimensional tolerances of the shank 40 and bore 14 and of the side edges of keel 36 and recess 12 provide slip-fit clearance. Thus, when these parts are fitted together and locked on the barrel 10, as depicted in FIG. 1, the sight 8 has maximum positional stability and will not be moved, relative to the barrel, by the forces of recoil.

Having thus described by invention, what is claimed is:

1. Removable front sight for the barrel of a fire-arm comprising an upwardly opening bore disposed adjacent the muzzle end of the barrel, a longitudinal hole extending on the muzzle of the barrel communicating with the bore and extending rearwardly thereof, a spring and detent disposed in the inner end of the hole so that the detent extends into said bore and a discrete front sight having an outer blade portion and a depending shank adapted to be removably fitted into the bore, said shank including a sculptured outer surface interengageable with the detent to enable longitudinal and angular movement of the shank in said bore for selective removal and remounting of said sight onto said barrel.

2. Removable front sight of the barrel of a fire-arm comprising an upwardly opening bore disposed adjacent the muzzle end of the barrel, a longitudinal hole extending on the muzzle of the barrel communicating with the bore and extending rearwardly thereof, a spring and a detent disposed in the inner end of the hole so that the detent extends into said bore and a discrete front sight having an outer blade portion and a depending shank adapted to be removably fitted into the bore, said shank having a sculptured outer surface including a downwardly opening longitudinal groove, a cavity angularly offset from the groove and a circumferential channel interconnecting the groove and cavity for inter-engagement with the detent to enable longitudinal and angular movements of the shank in said bore for selective removal and remounting of said sight onto said barrel.

3. Removable front sight for the barrel of a fire-arm, as set forth in claim 2, wherein a chamfer is provided at the lower end of said groove to guide the detent into said groove and wherein said cavity includes a cam surface engageable by said detent for urging said shank downwardly into said bore when the blade portion of the sight is aligned with the barrel of said firearm.,

4. Removable front sight for the barrel of a fire-arm, as set forth in claim 3, wherein said barrel is provided with a recess having a lower surface and a raised peripheral edge, said bore having its upper opening at the lower surface of said recess, said peripherial edge being rotatably engagable by said sight during horizontal angular movement of the shank in said bore.

5. Removable front sight for the barrel of a fire-arm, as set forth in claim 4, wherein said sight includes a keel disposed between the blade and shank portions thereof, said keel being dimensioned to fit within said recess when the blade of the sight is aligned with the barrel of said firearm.

6. Removable front sight for the barrel of a fire-arm, as set forth in claim 5, wherein said sight includes a flange adapted to engage the peripheral edges of said recess when the keel is disposed in said recess.

* * * * *